United States Patent [19]

Knaack et al.

[11] 4,288,134

[45] Sep. 8, 1981

[54] STORAGE CABINET

[75] Inventors: Howard L. Knaack; Kenneth F. Weger, Jr., both of Cary, Ill.

[73] Assignee: Knaack Manufacturing Company, Crystal Lake, Ill.

[21] Appl. No.: 179,969

[22] Filed: Aug. 21, 1980

[51] Int. Cl.[3] ..... A47B 81/00; A47B 95/02; E05B 67/38

[52] U.S. Cl. ..... 312/290; 312/244; 312/320; 312/DIG. 33; 312/100; 70/56

[58] Field of Search ..... 312/290, 100, 257 SK, 312/257 A, 320, 244, 108, 194, 297, DIG. 33; 70/56; 109/50, 59

[56] References Cited

U.S. PATENT DOCUMENTS

| | | | |
|---|---|---|---|
| 757,400 | 4/1904 | Guelff | 312/257 |
| 932,922 | 8/1909 | Ward | 312/297 |
| 940,416 | 11/1909 | Young | 312/290 |
| 1,272,245 | 7/1918 | Fitzgerald | 312/290 |
| 2,143,239 | 1/1939 | Foltz | 312/257 |
| 2,478,254 | 8/1949 | Doner | 312/290 |
| 2,544,822 | 3/1951 | Brown | 312/194 |
| 2,803,514 | 8/1957 | Calderon | 312/257 |
| 3,133,427 | 5/1964 | Petkwitz | 312/290 |
| 3,284,151 | 11/1966 | Morrison et al. | 312/244 |
| 3,316,048 | 4/1967 | Levy | 312/100 |
| 3,545,623 | 12/1970 | Andreasson | 312/108 |
| 3,550,978 | 12/1970 | Magee | 312/108 |
| 3,838,586 | 10/1974 | Tennison | 70/56 |
| 3,985,409 | 10/1976 | Kneier | 312/DIG. 33 |
| 3,992,069 | 11/1976 | Kitterman | 312/320 |
| 4,014,598 | 3/1977 | Stalley et al. | 312/320 |

FOREIGN PATENT DOCUMENTS

| | | | |
|---|---|---|---|
| 24366 | of 1905 | United Kingdom | 312/290 |

OTHER PUBLICATIONS

Knaack Catalog ©1978 No. K878.
CAMLEVER Brochure C139.

*Primary Examiner*—Victor N. Sakran
*Attorney, Agent, or Firm*—Wegner, Stellman, McCord, Wood & Dalton

[57] ABSTRACT

A storage cabinet having a body with front, rear and side walls extending upwardly from a bottom to define a storage space and having recessed handles mounted within recesses in the side walls and with preformed skid members secured to the underside of the bottom and adapted for attachment of casters. The particular storage cabinet disclosed additionally has a two-part cover with reinforcing members associated therewith to strengthen the cover and coact with the body components to render the storage cabinet more secure against theft.

15 Claims, 8 Drawing Figures

65
20
67
2.
66
63
11
21
136
137
4.
135
35
3.
36
34
15
3.
2.
50
51
52
57

65
122
66
102
24
121
125
127
46
11
45
33
40
41
31
36
34
32

105
68
111
110
25
112
15

106
29
11
68

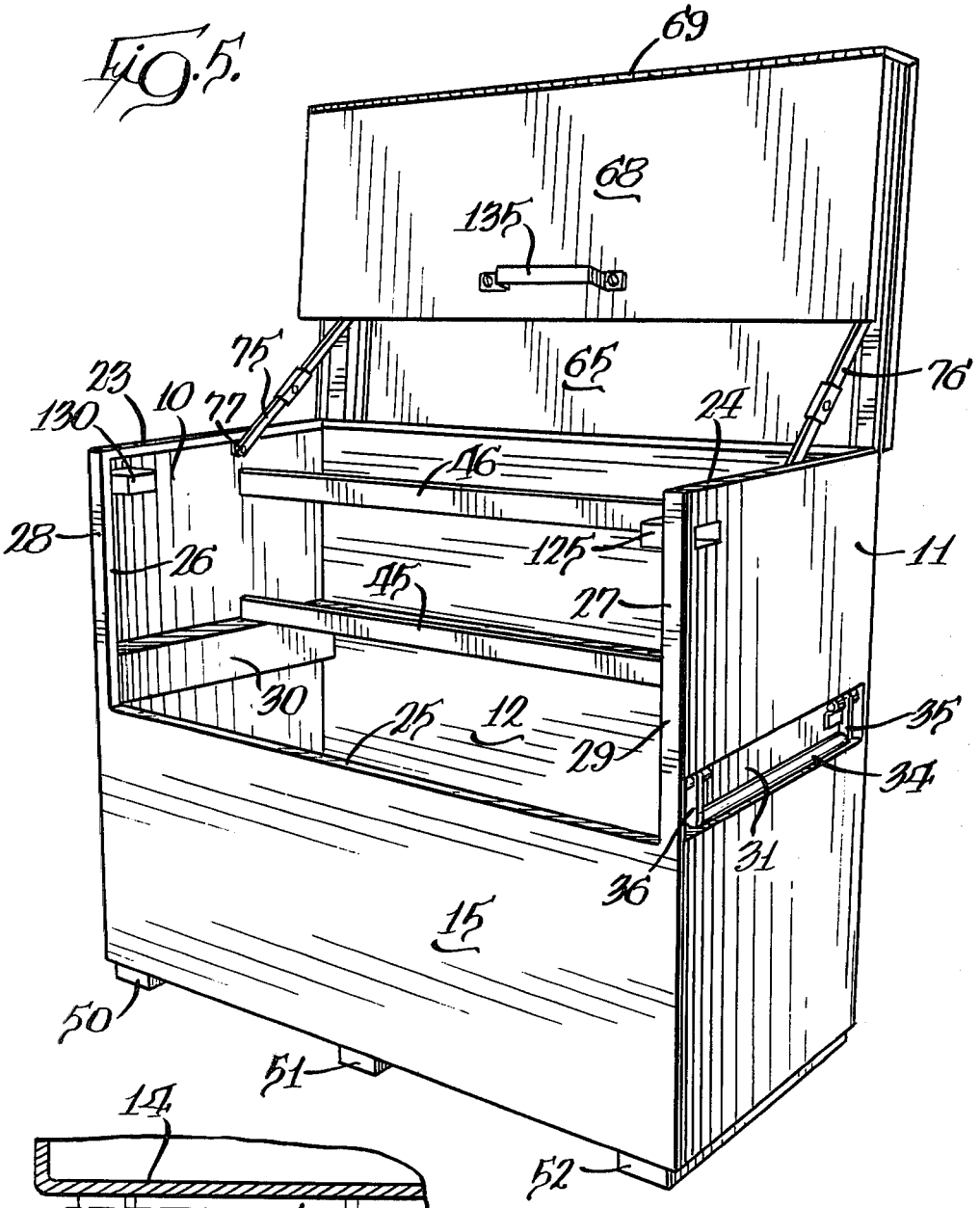
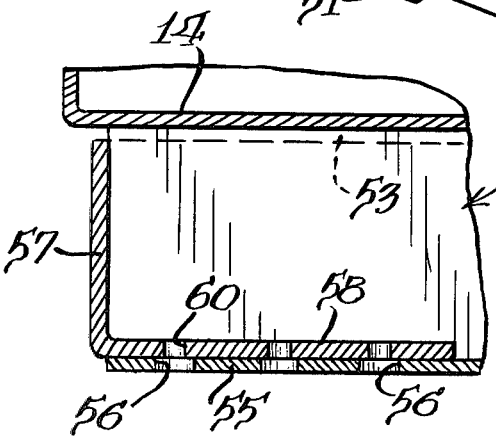
Fig.8.

STORAGE CABINET

BACKGROUND OF THE INVENTION

This invention pertains to storage cabinets usable for storage of tools and other equipment at a desired location, such as a job site, and with the cabinets having improved structure for strength, security against theft, ease of packaging and shipment and improved utility in the use thereof.

Prior storage cabinets for storage of tools and other equipment have had handle structure extended outwardly from the side walls thereof for use in lifting the cabinet, with such handles always protruding from the basic perimeter of the cabinet whereby the packaging of a cabinet for shipment is rendered more difficult and, when the cabinet is in use, the handles are protrusions which can cause accidental injury while walking adjacent to the storage cabinet.

Certain storage cabinets now in use are shaped to have a horizontal top when a cover is closed and with there being a front access opening to a storage space within the cabinet and with the cover being formed of two fixed sections, arranged generally at a right angle to each other with one part of the cover extending across the top of the cabinet and the other part extending downwardly to close the access opening when the cover is closed. Such construction results in an outward pivoting of the lower edge of the cover as the cover is raised to an open position, which results in cumbersome handling in opening of the cabinet and requires additional space at the front of the cabinet. There are also cabinets which have a top which is partly sloped and a two-part cover, with one part forming the sloped top and the other part closing a front access opening when the cover is closed. Such a construction reduces the total storage space within the cabinet.

SUMMARY OF THE INVENTION

A primary feature of the invention disclosed herein is to provide a storage cabinet which maximizes the storage space within the cabinet by utilization of a two-part cover with pivotally-connected parts, with structure associated therewith for strengthening of the cover parts and which are associated with the walls of the storage cabinet to prevent insertion of a pry bar to gain leverage in attempting to open the cabinet.

Another primary feature of the invention is to provide a storage cabinet having a new and improved structure in that the side walls of the cabinet are each formed with a strengthening rib which defines a recess in each side wall for mounting a pivotally mounted handle which has a stored position within the recess and which can be pivoted outwardly for use. The rib provides greater lifting capacity at the ends of the box and provides a shelf support for a shelf positioned within the storage cabinet and the recessing of the handle allows easier cartoning of the product for shipment and less freight damage and also prevents accidental injury while walking past the storage cabinet.

Another feature of the invention is to provide coacting structure between one part of the cover and the front of the cabinet including one of the reinforcing members which maintains an interfit between the front cabinet wall and the cover within a limited range of vertical movement whereby a lock structure associated with the cabinet for locking the cover closed may have a slight amount of vertical movement with the cover still retained in locked position.

Another feature of the invention is to provide a storage cabinet with skids in the form of box-shaped members secured to the underside of the cabinet with each member defining an interior chamber and with a series of openings at each end thereof and a pair of L-shaped plates welded to the ends of the member closing the interior chamber and having a section thereof with drilled or pierced holes aligned with the openings of said series to enable caster mounting by self-tapping screws.

In carrying out the foregoing, it is an object of the invention to provide a storage cabinet having a body with front, rear and side walls extending upwardly from a bottom to define a storage space, each of said side walls having a formed, horizontally-extending rib defining a recess for strengthening of the side walls, and a pair of handles pivotally mounted, one in each of said recesses, for movement between a storage position lying within the recess and behind the exterior faces of the side walls, to operative positions extended outwardly of the recesses.

Another object of the invention is to provide a storage cabinet as defined in the preceding paragraph including members secured to the underside of the bottom, each including a formed member with an interior chamber and a series of openings, and a pair of plates secured one to each end of the formed member with a part thereof within the chamber and having holes in alignment with said openings of said series for mounting of casters by threading into said holes.

Still another object of the invention is to provide a storage cabinet as defined in the preceding paragraphs wherein the side walls have upper edges which lie in a plane parallel to the bottom and said front wall has a major part thereof with an upper edge positioned at a lower level than said plane to provide a front access opening. The two-part cover for said cabinet is hinged along the upper edge of said rear wall with one part of the cover of a width to span the upper edges of the side walls and having a section at a right angle to the major part thereof, the other part of the cover being hinged to said section along an edge thereof and having a width and length to coact with said section and cover said access opening when the cover is closed. Reinforcing members are secured to the underside of the cover parts and positioned to lie immediately within the upper edges of the side walls and parts of the front wall to strengthen the cover and deter insertion of a prying tool. One of the reinforcing members is secured to the free edge of the other part of the cover and has a flange spaced therefrom to provide a U-shaped space for receiving and interfitting with the upper edge of the front wall, said space having a sufficient height to maintain said interfit for a limited amount of movement of the cover upwardly relative to the front wall, and lock means associated with the body and cover including a pair of lock members pivotally mounted on said reinforcing members secured to said one part of the cover and a pair of padlock holders secured to the side walls within the storage space and opening to the exterior of the side walls for exterior access.

BRIEF DESCRIPTION OF THE DRAWINGS

FIG. 5 is a perspective view of the storage cabinet, with the cover shown in open position and with the cover handle shown in operative position;

FIG. 8 is a fragmentary vertical section, taken generally along the line 8—8 in FIG. 7 and on an enlarged scale.

DESCRIPTION OF THE PREFERRED EMBODIMENT

Figure 1:
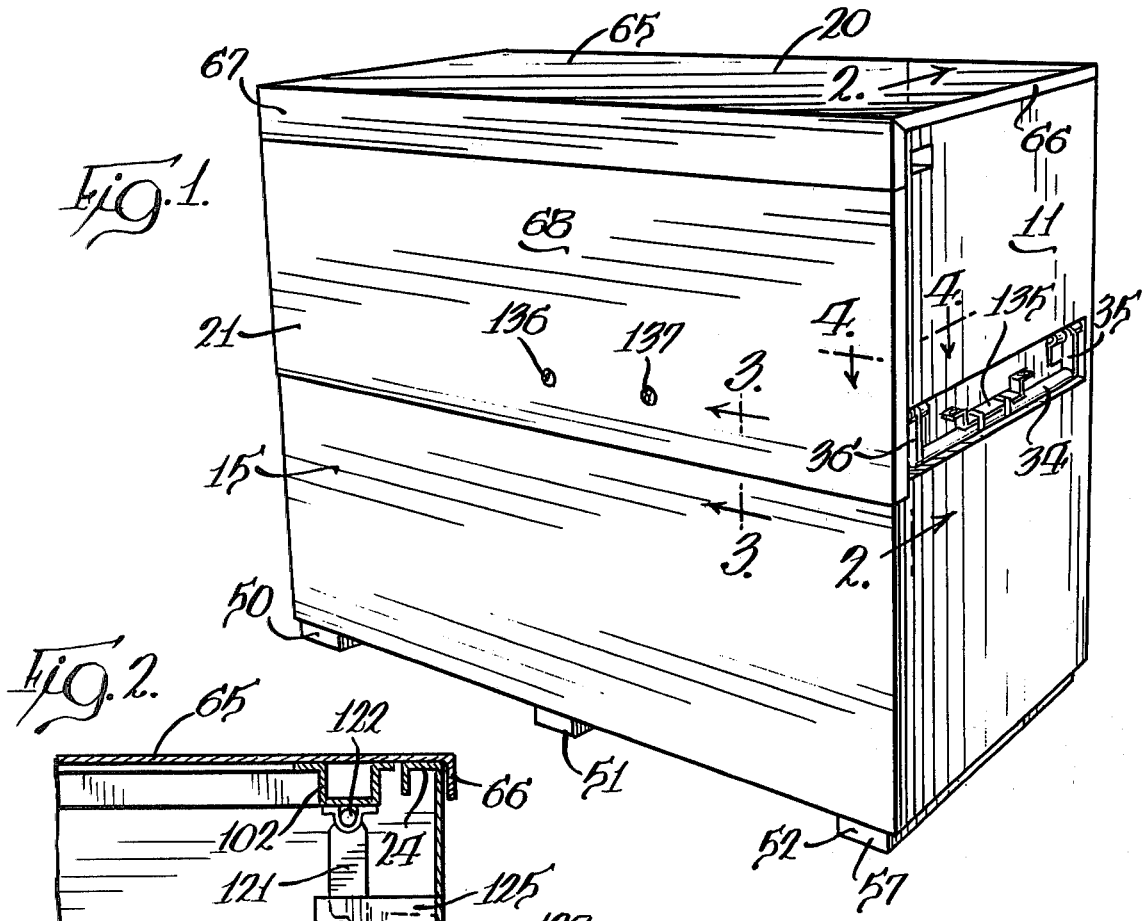
FIG. 1 is a perspective view of the storage cabinet with the cover shown in closed position and with a cover handle shown in shipping position.

The storage cabinet is shown generally in FIGS. 1 and 5 in closed and open positions, respectively. The storage cabinet has a pair of side walls 10 and 11, a rear wall 12, a bottom 14, and a front wall 15. A two-part cover having parts 20 and 21 closes the storage cabinet and provides a flat top surface therefor as seen in FIG. 1.

The side walls 10 and 11 have upper edges which lie in a plane parallel with the bottom of the storage cabinet and which are defined by extra-wide returns 23 and 24. The front wall 15 has a major part thereof with an edge 25 positioned at a lower level than the upper edges 23 and 24 of the side walls to provide a front access opening to the storage space defined by the cabinet walls and bottom. The front wall edge 25 is defined by an extra-wide return which strengthens the front edge of the box and which extends to extra-wide returns 26 and 27 formed on parts 28 and 29 of the front wall which extend upwardly from the front wall edge 25 to the level of the side wall edges 23 and 24. The extra-wide returns which define the aforesaid edges provide added strength for the storage cabinet, with the components thereof made from sheet metal and enhance the appearance of the storage cabinet.

Each of the side walls 10 and 11 has a portion defining a formed, horizontally-extending integral rib defining a recess for strengthening of the side wall. Each of these ribs has an inwardly positioned vertically-extending panel section 30 and 31, respectively, with horizontally-extending sections, such as shown at 32 and 33 in FIG. 2, extending to the exterior face of the side wall. Each recess pivotally mounts a handle which has a storage position lying within the recess and behind the exterior face of the side wall and pivotally movable to an operative position extended outwardly of the recess.

Figure 2:
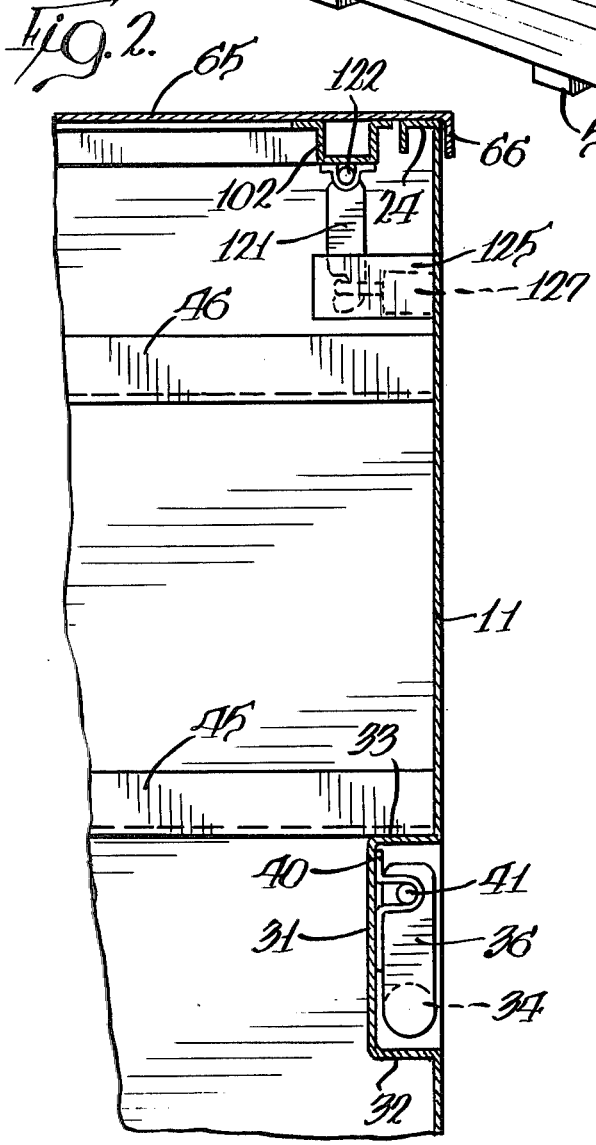
FIG. 2 is a vertical section, on an enlarged scale, taken generally along the line 2—2 in FIG. 1.

The handle associated with side wall 11 is particularly shown in the drawings and with the handle associated with the other side wall being mounted in the same manner and of the same construction. The handle has an engaging bar 34 extended between a pair of arms 35 and 36 and which are each pivotally-mounted to a strap welded to the vertically-extending panel section 30, 31 and which mount a pivot pin extended through an opening in the arm. FIG. 2 shows the strap 40 which is welded to the panel section 31 and which mounts the pivot pin 41. With the recessed handle structure, formation of the ribs in the side walls imparts added strength to the side walls of the storage cabinet. The mounting of the handle in the recess avoids any protrusion beyond the exterior faces of the side wall to facilitate cartoning of the storage container for shipment and reducing freight damage as well as preventing accidental contact with a person walking next to the storage cabinet.

An added feature of the recessed rib structure is that the upper, horizontally-extending part thereof, such as the part 33 shown in FIG. 2, provides a support for an end of a shelf 45 positioned within the storage space and extending between the side walls and having its ends welded to the interior faces of the side walls. As shown in the particular storage cabinet disclosed, there is a second shelf 46 disposed in spaced relation above the shelf 45.

Figure 7:
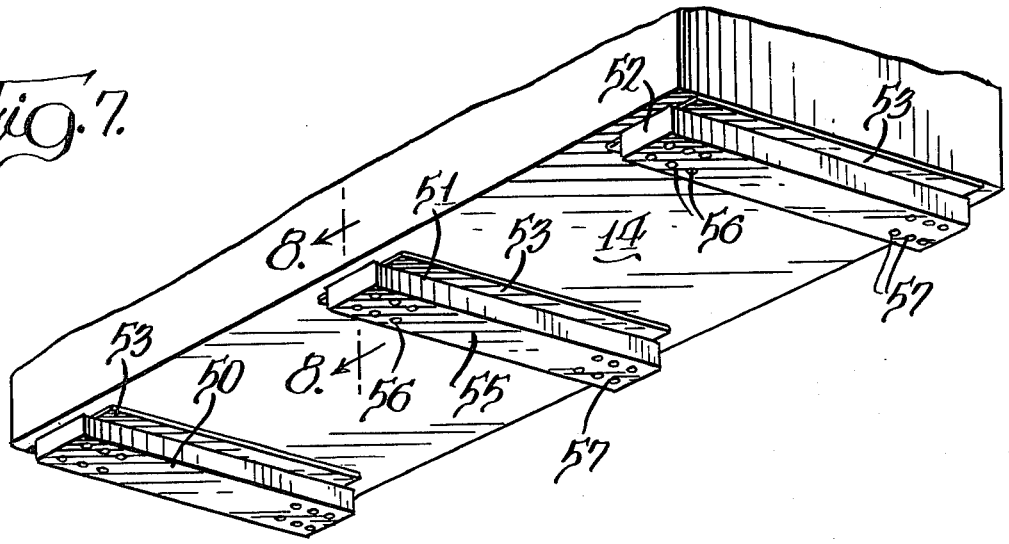
FIG. 7 is a fragmentary bottom perspective view of the storage cabinet.

The storage cabinet has skid structure on the underside thereof in the form of three skid members 50, 51 and 52, shown in FIG. 7. Each of these skid members is a box-formed member having integral flanges 53 extending from opposite sides thereof which are welded to the bottom 14 of the storage cabinet. An intermediate panel 55 of the box-formed member is spaced from the storage cabinet bottom and has a series of openings 56 and 57 at opposite ends thereof. The box-formed member has opposite ends which open to an interior chamber and a pair of L-shaped plates are associated, one with each end of a skid member, for closing the interior chamber, as shown by a leg 57 of a plate in FIG. 8 and with another leg 58 of the L-shaped plate overlying the intermediate panel 55. The vertical edges of the leg 57 are welded to the ends of the box-shaped member. The leg 58 of the L-shaped plate has a series of drilled or pierced openings 60 which are of a size smaller than the openings 56, but in concentric alignment therewith whereby casters may be mounted to the underside of the skid members by insertion of self-tapping screws into the openings 60. Each of the skid members is of the construction particularly described in connection with the skid member 51.

The cover 20 is formed of two parts, with one part 65 being hinged along an edge by a hinge (not shown) extending along the upper edge of the storage cabinet rear wall 12, whereby the cover can move between the closed position, shown in FIG. 1, and the open position, shown in FIG. 5. The cover part 65 is of a width, as viewed in FIG. 1, to span the upper edges 23 and 24 of the side walls, with downturned cover flanges, one of which is shown at 66, overlapping the edge 24, as shown in FIG. 2. The cover part 65 has a section 67 formed at right angles thereto which pivotally mounts another part 68 of the cover along an edge of said section by hinge means 69. Said section 67 of the cover part 65 and the cover part 68 have a width and length to cover said access opening to the storage space when the cover is closed and have turned-in flanges at their perimeter similar to the flange 66 to overlap the exterior faces of the side walls.

Figure 6:
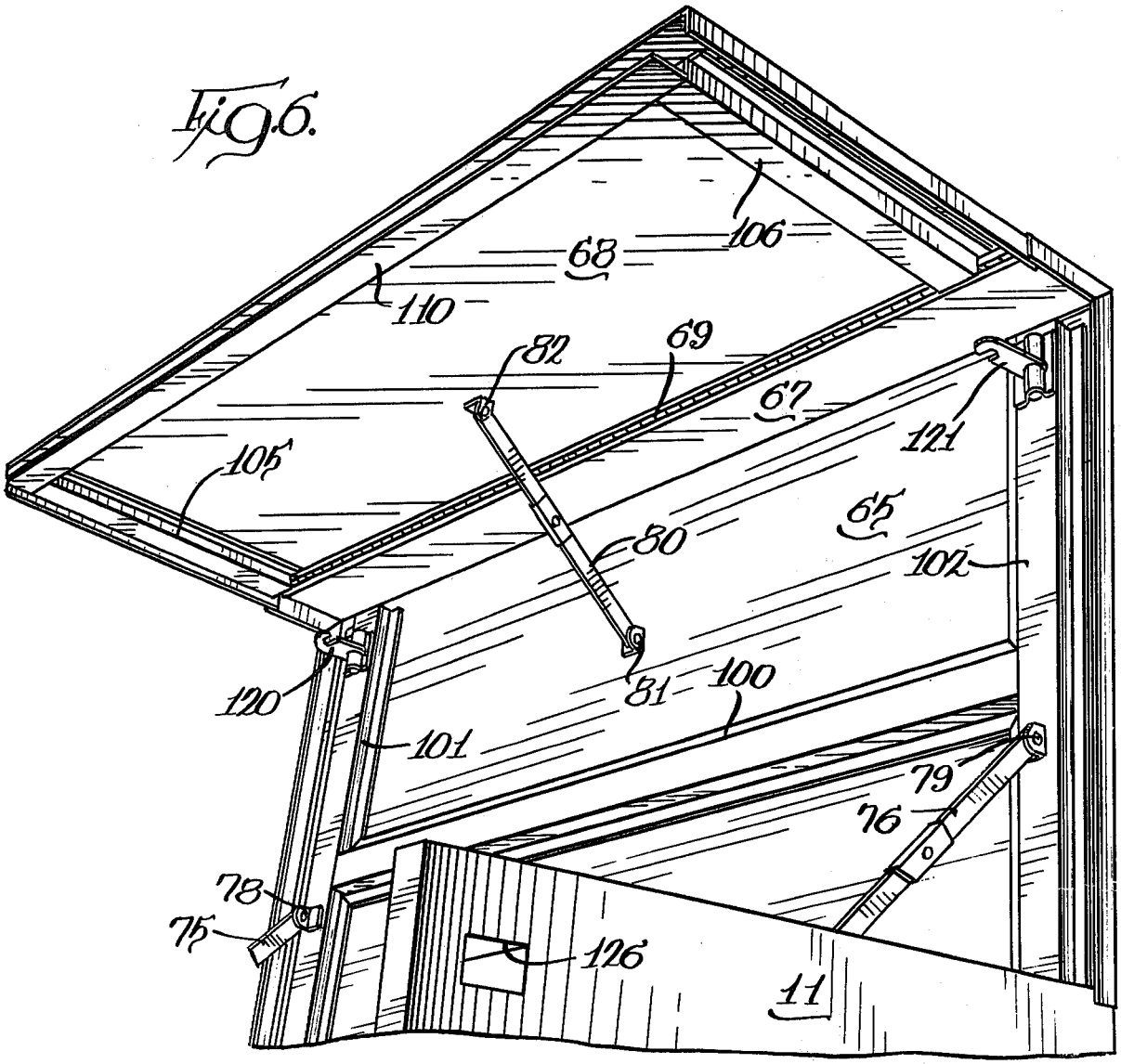
FIG. 6 is a fragmentary perspective view of the storage cabinet as shown in FIG. 5 and on an enlarged scale showing one part of the cover in other than a normal position.

As shown in FIGS. 5 and 6, a pair of extensible lock arms 75 and 76 are operable to hold the cover in open position, with the cover parts 68 and 65 in generally parallel and vertically-disposed relation for full access to the storage space. When the cover is to be closed, the lock arms are released to permit the closing of the cover. The lock arms are pivotally connected at their opposite ends between the interior face of the cover part 65 and the side walls, with a pivot connection of the lock arm 75 to the side wall being shown at 77, and a pivot connection of the lock arms to the underside of the cover part 65 being shown at 78 and 79. Normally, the cover is either in the closed position of FIG. 1 or the open position of FIG. 5. In order to show certain structure, the cover parts are shown in a different relation in FIG. 6. A cover restrictor, in the form of a releasable lock arm 80, has its opposite ends pivotally connected between the cover parts 65 and 68, as shown at 81 and 82. This lock arm limits pivotal movement of the cover part 68 relative to the cover part 65 when the cover is being opened and is necessary because of the hinge 69 pivotally interconnecting these parts. The lock arm 80 limits the relative pivotal movement to approximately an angle of 90°. The lock arm 80 is selectively operable, so that if the cover is raised without swinging the cover parts through an angle of approximately 90° relative to each other, the lock arm will not engage and the cover parts may readily move to the position shown in FIG. 5. If the full relative movement does occur, the lock arm can be released when the cover part 65 is vertical to permit the cover part 68 to be lowered to the vertical position shown in FIG. 5.

The cover has elongate reinforcing members secured to the underside thereof which strengthen the cover and coact with the walls of the storage cabinet to prevent insertion of a tool, such as a pry bar, in an attempt to open a locked storage cabinet. The reinforcing members shown in association with the cover part 65 include a transverse reinforcing member 100 which extends along the width of the cover part 65 and is welded to the underside thereof and at its ends welded to a pair of reinforcing members 101 and 102, with one of the latter reinforcing member being shown in cross section in FIG. 2. The reinforcing members are generally of a U-shape, with a pair of outwardly-extending flanges which can be spot welded to the underside of the cover part 65 and the reinforcing members 101 and 102 are positioned on the underside of the cover part 65 to lie closely adjacent to the returns defining the upper edges 23 and 24 of the side walls 10 and 11 when the cover is closed. This relation is shown for the reinforcing member 102 in FIG. 2 which is closely adjacent to the upper edge 24 of the side wall 11. The location of the reinforcing members prevents insertion of a pry bar from the top of the box to gain leverage in attempting to pry the front cover upwardly.

Figure 4:
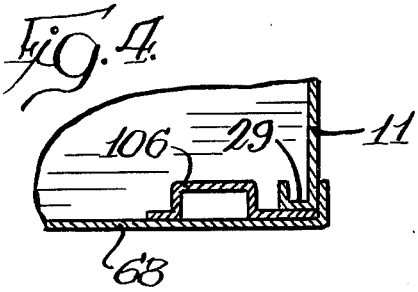
FIG. 4 is a fragmentary section, on an enlarged scale, taken generally along the line 4—4 in FIG. 1.

The cover part 68 has a pair of reinforcing members 105 and 106 of the same basic structure as the reinforcing member 102, previously referred to, and which are spot-welded to the underside of the cover part. As shown in FIG. 4, for the reinforcing member 106, such reinforcing members is positioned on the underside of the cover part to lie closely adjacent to the parts of the front wall extending upwardly at either side of the access opening, such as the front wall part 29 to prevent insertion of a pry bar from the side of the storage cabinet to gain leverage in attempting to pry the cover forwardly.

Figure 3:
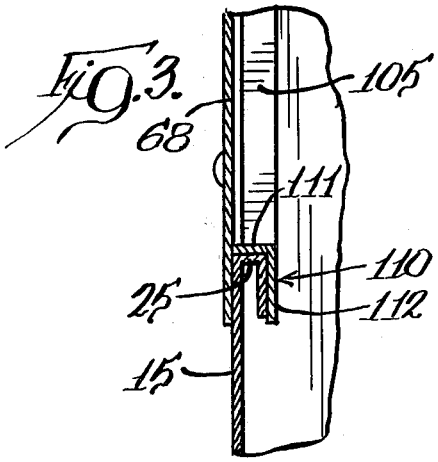
FIG. 3 is a fragmentary vertical section, on an enlarged scale, taken generally along the line 3—3 in FIG. 1.

An additional reinforcing member 110 is associated with the underside of the cover part 68 and extends along the free edge thereof to coact with the upper edge 25 of the front wall 15, as shown particularly in FIG. 3. The reinforcing member 110 is a generally L-shaped member having a part 111 extended between the reinforcing members 105 and 106 and welded thereto as well as welded to the underside of the cover part 68 along the length thereof and having a downwardly-extending part 112 which, together with the internal face of the cover part 68, defines a U-shaped space for receiving and interfitting with the upper edge 25 of the front wall. As seen in FIG. 3, the space has a sufficient height to maintain said interfitting relation regardless of a limited amount of vertical movement of the cover from the fully-closed position shown in FIG. 3. This interfit provides a good tight seal for the free edge of the cover part 68 and also enables the interlock to be maintained, even when there is some play in a lock structure to be described.

The storage cabinet can be locked by a structure of the type shown in our copending application, Ser. No. 153,841, filed May 27, 1980. Reference may be made to said copending application for a more detailed description of the lock structure and the structure disclosed therein is incorporated herein by reference. The lock means is associated with the body of the storage cabinet and the cover and includes a pair of lock members 120 and 121 which are pivotally mounted to the respective reinforcing members 101 and 102 on the underside of the cover part 65. The mounting of the lock member 121 is particularly shown in FIG. 2 wherein it is pivotally mounted to the reinforcing member 102 by a pivot pin 122. The lock members coact with a pair of padlocks captured within a pair of padlock holders secured to the side walls and opening to the exterior of the side walls for access. A padlock holder 125 is in the form of a tubular box welded to the interior of the cabinet side wall 11 and having an opening 126 to the exterior of the storage cabinet. A padlock 127 positioned within the holder 125 has the hasp hereof positioned to coact with a notch at the lower end of the lock member 121 when the cover is closed to obtain the locked relation shown in FIG. 2 whereby the cover is locked until the padlocks are unlocked and the hasps are freed from their relation with the lock members. The padlock holder associated with the side wall 10 is of the same construction as identified at 130.

The cover is provided with a handle 135, as shown in FIG. 5, in operative association with the cover by mounting to the cover part 68. This mounting is by fastening members which extend through openings 136 and 137 in the cover part, as shown in FIG. 1. For shipment, the cover handle can be taped to the engaging bar 34 of the handle located in the recess whereby the cover handle does not protrude during shipment.

With the foregoing structure, a storage cabinet is provided which is extra-strong because of reinforcing members which have additional functions to improve the utility of the storage cabinet and with the storage cabinet having the other described structural improvements which facilitate shipment, use and security.

We claim:

1. A storage cabinet of sheet metal having a body with front, rear and side walls extending upwardly from a bottom to define a storage space, said side walls having upper edges which lie in a plane parallel to said bottom and said front wall having a major part thereof with an upper edge positioned at a lower level than said plane to provide a front access opening, a two-part cover for said cabinet hinged along the upper edge of said rear wall with one part of the cover of a width to span the upper edges of the side walls and having a section at a right angle to the major part thereof, the other part of the cover being hinged to said section along an edge thereof and having a width and length to coact with said section and cover said access opening when the cover is closed, a cover restrictor connected between said cover parts to limit relative pivotal movement of said parts and movable to a position to permit said cover parts to lie in close generally parallel relation when the cover is open, elongate reinforcing members secured to the underside of the cover parts and positioned to lie immediately within the upper edges of the side walls and parts of the front wall extending upwardly at either side of the access opening to strengthen the cover and deter insertion of a prying tool, a reinforcing member secured to the free edge of the other part of the cover and having a flange spaced therefrom to provide a U-shaped space for receiving and interfitting with the front wall edge which is positioned at said lower level, said space having a sufficient height to maintain said interfit for a limited amount of movement of the cover upwardly relative to the front wall, lock means associated with the body and the cover including a pair of lock members pivotally mounted on said reinforcing members secured to said one part of the cover and a pair of padlock holders secured to said side walls within the storage space and opening to the exterior of the side walls for exterior access, each of said side walls having a formed horizontally-extending rib defining a recess for strengthening of the side walls, a pair of handles pivotally mounted one in each of said recesses for movement between a storage position lying within the recess and behind the exterior faces of the side walls to operative positions extended outwardly of the recesses, a shelf within the storage space secured at its ends to said side walls and resting upon the side wall ribs, and skid members secured to the underside of said bottom each including a formed member with an interior chamber and a series of openings, and a pair of plates secured to the formed member within the chamber at opposite ends thereof and having holes in alignment with said openings for mounting of casters on the underside of said skid members.

2. A storage cabinet having a body with front, rear and side walls extending upwardly from a bottom to define a storage space, said side walls having upper edges which lie in a plane parallel to said bottom and said front wall having a major part thereof with an upper edge positioned at a lower level than said plane to provide a front access opening, a two-part cover for said cabinet hinged along the upper edge of said rear wall with one part of the cover of a width to span the upper edges of the side walls and having a section at a right angle to the major part thereof, the other part of the cover being hinged to said section along an edge thereof and having a width and length to coact with said section and cover said access opening when the cover is closed, elongate reinforcing members secured to the underside of the cover parts and positioned to lie immediately within the upper edges of the side walls and parts of the front wall extending upwardly at either side of the access opening to strengthen the cover and deter insertion of a prying tool, a reinforcing member secured to the free edge of the other part of the cover and having a flange spaced therefrom to provide a U-shaped space for receiving and interfitting with the front wall edge which is positioned at said lower level, said space having a sufficient height to maintain said interfit for a limited amount of movement of the cover upwardly relative to the front wall, lock means associated with the body and the cover including a pair of lock members pivotally mounted on said reinforcing members secured to said one part of the cover and a pair of padlock holders secured to said side walls within the storage space and opening to the exterior of the side walls for exterior access, each of said side walls having a formed horizontally-extending rib defining a recess for strengthening of the side walls, and a pair of handles pivotally mounted one in each of said recesses for movement between a storage position lying within the recess and behind the exterior faces of the side walls to operative positions extended outwardly of the recesses.

3. A storage cabinet having a body with a front, rear and side walls extending upwardly from a bottom to define a storage space, said side walls having upper edges which lie in a plane parallel to said bottom and said front wall having a major part thereof with an upper edge positioned at a lower level than said plane to provide a front access opening, a two-part cover for said cabinet hinged along the upper edge of said rear wall with one part of the cover of a width to span the upper edges of the side walls, the other part of the cover being hinged to said one part of the cover and having a width and length to extend downwardly and cover said access opening when the cover is closed, elongate reinforcing members secured to the underside of the cover parts and positioned to lie immediately within the upper edges of the side walls and parts of the front wall extending upwardly at either side of the access opening to strengthen the cover and deter insertion of a prying tool, a reinforcing member secured to the free edge of the other part of the cover and having a flange spaced therefrom to provide a U-shaped space for receiving and interfitting with the front wall edge which is positioned at said lower level, said space having a sufficient height to maintain said interfit for a limited amount of movement of the cover upwardly relative to the front wall, and lock means associated with the body and the cover including a pair of lock members pivotally mounted on said reinforcing members secured to said one part of the cover and a pair of padlock holders secured to said side walls within the storage space and opening to the exterior of the side walls for exterior access.

4. A storage cabinet of sheet metal having a body with front, rear and side walls extending upwardly from a bottom to define a storage space, said side walls having upper edges which lie in a plane parallel to said bottom and said front wall having a major part thereof with an upper edge positioned at a lower level than said plane to provide a front access opening, a two-part cover for said cabinet hinged along the upper edge of said rear wall with one part of the cover of a width to span the upper edges of the side walls and having a section at a right angle to the major part thereof, the other part of the cover being hinged to said section along an edge thereof and having a width and length to coact with said section and cover said access opening when the cover is closed, a cover restrictor connected between said cover parts to limit relative pivotal movement of said parts and movable to a position to permit said cover parts to lie in close generally parallel vertical relation when the cover is open, elongate reinforcing members secured to the underside of the cover parts and positioned to lie immediately within the upper edges of the side walls and parts of the front wall extending upwardly at either side of the access opening to strengthen the cover and deter insertion of a prying tool, a reinforcing member secured to the free edge of the other part of the cover and having a flange spaced therefrom to provide a U-shaped space for receiving and interfitting with the front wall edge which is positioned at said lower level, said space having a sufficient height to maintain said interfit for a limited amount of movement of the cover upwardly relative to the front wall, and lock means associated with the body and the cover.

5. A storage cabinet of sheet metal having a body with front, rear and side walls extending upwardly from a bottom to define a storage space, each of said side walls having an integrally formed rib portion, defining an outwardly opening recess, for strengthening of the side walls, each said rib portion extending between said front and rear walls, a structural member extending between said side walls adjacent said rear wall and having end portions adjacent said rib portions, means for securing the end portion of said structural member to said side walls adjacent said rear wall for further strengthening of the side walls and rigidifying of the cabinet configuration, and a pair of handles pivotally mounted to said rib portions adjacent said front and rear walls one in each of said recesses for movement between (a) a storage position lying within the recess and behind the exterior faces of the side walls and (b) operative positions wherein the handles are extended outwardly of the recesses, the strengthening and rigidifying of said cabinet by said rib portions and the securing of said structural member to said side walls adjacent the pivotal mounting of the handles to the rib portions providing an improved strong mounting of the handles to said cabinet.

6. A storage cabinet as defined in claim 5 including skid members secured to the underside of said bottom each including a formed member with an interior chamber and a series of openings, and a plate secured to the formed member within the chamber and having holes in alignment with said openings for mounting of casters on said skid members.

7. A storage cabinet as defined in claim 6 wherein said skid members each have a pair of said plates secured to the formed member, said plates each having an angled section positioned to close the ends of a skid member.

8. A storage cabinet as defined in claim 5 wherein said structural member comprises a shelf extending along the storage space and having ends positioned upon the side wall ribs and secured to the interior of the side walls.

9. A storage cabinet of sheet metal having a body with front, rear and side walls extending upwardly from a bottom to define a storage space, each of said side walls having a formed horizontally-extending rib defining a recess for strengthening of the side walls, and a pair of handles pivotally mounted one in each of said recesses for movement between a storage position lying within the recess and behind the exterior faces of the side walls to operative positions extended outwardly of the recesses, said cabinet having a cover and defining an underside, and including reinforcing members on said underside of the cover, and lock means associated with the body and the cover including a pair of lock members pivotally mounted on said reinforcing members secured to said one part of the cover and a pair of padlock holders secured to said side walls within the storage space and opening to the exterior of the side walls for exterior access.

10. A storage cabinet as defined in claim 5 having a cover comprising two parts, one part being hinged to the upper back of the rear wall and the other part being pivotally connected thereto, and a reinforcing member having a first portion secured to the free edge of the other part of the cover and having a flange spaced from said other part and cooperating with said other part to provide a U-shaped space for receiving and interfitting with the upper edge of the front wall, said space having a sufficient height to maintain said interfit for a limited amount of movement of the cover upwardly relative to the front wall.

11. A storage cabinet as defined in claim 5 wherein said side walls have upper edges which lie in a plane parallel to said bottom and said front wall has a major part thereof with an upper edge positioned at a lower level than said plane to provide a front access opening, said cabinet further having a cover comprising two parts hinged along the upper edge of said rear wall with one part of the cover of a width to span the upper edges of the sidewalls and having a section at a right angle to the major part thereof, the other part of the cover being hinged to said section along an edge thereof and having a width and length to coact with said section and cover said access opening when the cover is closed, and a reinforcing member having a first portion secured to the free edge of the other part of the cover and having a flange spaced from said other part and cooperating with said other part to provide a U-shaped space for receiving and interfitting with the front wall edge which is positioned at said lower level, said space having a sufficient height to maintain said interfit for a limited amount of movement of the cover upwardly relative to the front wall.

12. A storage cabinet having a body with front, rear and side walls extending upwardly from a bottom to define a storage space, and skid members secured to the underside of said bottom each including a box-shaped formed member with flanges secured to the underside of the bottom and an intermediate panel spaced from the bottom to define an interior chamber, a series of openings at each end of the panel, a pair of L-shaped plates positioned at opposite ends of a formed member with one leg of the L-shaped plates closing off the ends of the chamber and the other legs of the L-shaped plates lying behind said intermediate panel and having holes in alignment with the openings of said series.

13. A storage cabinet of sheet metal having a body with front, rear and side walls extending upwardly from a bottom to define a storage space, said side walls having upper edges which lie in a plane parallel to said bottom and said front wall having a major part thereof with an upper edge positioned at a lower level than said plane to provide a front access opening, a two-part cover for said cabinet hinged along the upper edge of said rear wall with one part of the cover of a width to span the upper edges of the side walls and having a section fixed at a right angle to the major part thereof, the other part of the cover being hinged to said section along an edge thereof and having a width and length to coact with said section and cover said access opening when the cover is closed, a reinforcing member secured to the free edge of the other part of the cover and having a flange spaced therefrom to provide a U-shaped space for receiving and interfitting with the front wall edge which is positioned at said lower level, said space having a sufficient height to maintain said interfit for a limited amount of movement of the cover upwardly relative to the front wall, and elongate reinforcing members secured to the underside of the cover parts and positioned to lie immediately within the upper edges of the side walls and parts of the front wall extending upwardly at either side of the access opening to strengthen the cover and deter insertion of a prying tool.

14. A storage cabinet of sheet metal having a body with front, rear and side walls extending upwardly from a bottom to define a storage space, said side walls having upper edges which lie in a plane parallel to said bottom and said front wall having a major part thereof with an upper edge positioned at a lower level than said plane to provide a front access opening, a two-part cover for said cabinet hinged along the upper edge of said rear wall with one part of the cover of a width to span the upper edges of the side walls and having a section at a right angle to the major part thereof, the other part of the cover being hinged to said section along an edge thereof and having a width and length to coact with said section and cover said access opening when the cover is closed, elongate reinforcing members secured to the underside of the cover parts and positioned to lie immediately within the upper edges of the side walls and parts of the front wall extending upwardly at either side of the access opening to strengthen the cover and deter insertion of a prying tool, and a reinforcing member secured to the free edge of the other part of the cover and having a flange spaced therefrom to provide a U-shaped space for receiving and interfitting with the front wall edge which is positioned at said lower level, said space having a sufficient height to maintain said interfit for a limited amount of movement of the cover upwardly relative to the front wall.

15. A storage cabinet of sheet metal having a body with front, rear and side walls extending upwardly from a bottom to define a storage space, said side walls having upper edges which lie in a plane parallel to said bottom and said front wall having a major part thereof with an upper edge positioned at a lower level than said plane to provide a front access opening, a two-part cover for said cabinet hinged along the upper edge of said rear wall with one part of the cover of a width to span the upper edges of the side walls and having a section at a right angle to the major part thereof, the other part of the cover being hinged to said section along an edge thereof and having a width and length to coact with said section and cover said access opening when the cover is closed, and elongate reinforcing members secured to the underside of the cover parts and positioned to lie immediately within the upper edges of the side walls and parts of the front wall extending upwardly at either side of the access opening to strengthen the cover and deter insertion of a prying tool.

* * * * *